US008172970B2

(12) United States Patent
Sussmann

(10) Patent No.: US 8,172,970 B2
(45) Date of Patent: May 8, 2012

(54) METHOD FOR THE PRODUCTION OF AN UPPER SHOE PART

(75) Inventor: Reinhold Sussmann, Scheinfeld (DE)

(73) Assignee: Puma SE, Herzogenaurach (DE)

( * ) Notice: Subject to any disclaimer, the term of this patent is extended or adjusted under 35 U.S.C. 154(b) by 344 days.

(21) Appl. No.: 12/671,434

(22) PCT Filed: Jul. 19, 2008

(86) PCT No.: PCT/EP2008/005931
§ 371 (c)(1),
(2), (4) Date: Jan. 29, 2010

(87) PCT Pub. No.: WO2009/015793
PCT Pub. Date: Feb. 5, 2009

(65) Prior Publication Data

US 2010/0186874 A1 Jul. 29, 2010

(30) Foreign Application Priority Data

Jul. 30, 2007 (DE) ..... 10 2007 035 729

(51) Int. Cl.
*B29C 65/04* (2006.01)
*B29C 65/08* (2006.01)
*B29C 65/16* (2006.01)
*A43B 23/00* (2006.01)

(52) U.S. Cl. ..... 156/73.1; 156/272.8; 156/274.4; 156/309.6; 36/45; 12/146 C

(58) Field of Classification Search ..... 156/73.1, 156/272.8, 274.4, 275.1, 290, 309.6; 36/45; 12/146 C
See application file for complete search history.

(56) References Cited

U.S. PATENT DOCUMENTS

| | | | | |
|---|---|---|---|---|
| 3,785,900 | A | 1/1974 | Gras | |
| 6,910,288 | B2 * | 6/2005 | Dua | 36/45 |
| 2004/0118018 | A1 | 6/2004 | Dua | |
| 2005/0075027 | A1 | 4/2005 | Etchells et al. | |
| 2006/0148358 | A1 * | 7/2006 | Hall et al. | 442/328 |
| 2006/0276095 | A1 | 12/2006 | Dua et al. | |

FOREIGN PATENT DOCUMENTS

| | | |
|---|---|---|
| DE | 88 02 185 | 5/1988 |
| DE | 19642253 A1 | 8/1997 |

* cited by examiner

*Primary Examiner* — Michael Tolin
(74) *Attorney, Agent, or Firm* — Lucas & Mercanti, LLP

(57) ABSTRACT

The invention relates to a method for the production of at least one layer (1) of a shoe upper or of a part of a shoe upper, wherein a nonwoven fabric (2) made of thermoplastic elastomere (TPE) is used as the basic material for at least a section of the layer (1) of the shoe upper. To influence the local properties of the material selectively in a cost efficient manner the invention suggests that at least partitions (3) of the surface of the nonwoven fabric (2) are exposed to a welding beam (4) in such a manner, that in those partitions (3) at least a partial melting of the nonwoven fabric (2) takes place, so that the density of the material is increased in the molten partitions (3).

15 Claims, 3 Drawing Sheets

METHOD FOR THE PRODUCTION OF AN UPPER SHOE PART

Figure 1:
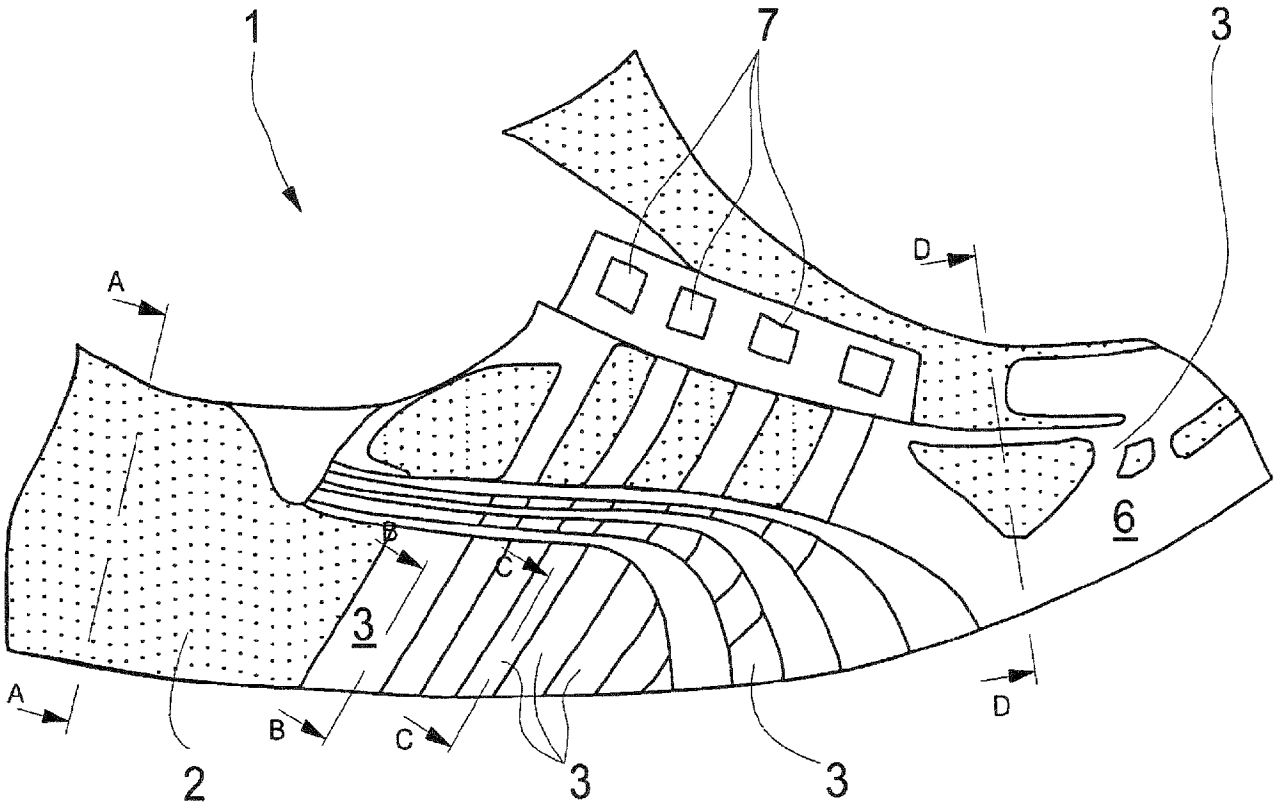

This application is a 371 of PCT/EP2008/005931 filed Jul. 19, 2008, which in turn claims the priority of DE 102007 035 729.1 filed Jul. 30, 2007, the priority of both applications is hereby claimed and both applications are incorporated by reference herein.

The invention relates to a method for the production of at least one layer of a shoe upper or of a part of a shoe upper, wherein a nonwoven fabric made of thermoplastic elastomere is used as the basic material for at least a section of the layer of the shoe upper.

For the design of a shoe and especially of the shoe upper different materials are known, wherein not only leather or artificial leather can be used but also—as generically suggested here—a nonwoven fabric.

A nonwoven fabric is an area-measured material made from single filaments. In distinction to this (textile) fabrics are made of yarn. The filaments consist of thermoplastic elastomers (TPE) in the present case. This are synthetic materials which behave comparable to classical elastomers at room temperature, but which can be deformed plastically during application of heat and thus show a thermoplastic behaviour.

Classical elastomers are chemical wide-meshed cross-linked spatial molecules. The cross-linkages cannot be loosened without decomposition of the material. Thermoplastic elastomers have physical crosslinking points in partitions (partial valency forces or crystallite) which dissolve under heat without decomposition of the macro molecules. Thus, they can be much better manipulated than normal elastomers. But this is also the reason that the material properties of thermoplastic elastomers change along time and temperature non-linear.

According to the inner design it is differentiated between block copolymers and elastomer alloys. Block copolymers have hard and soft segments within a molecule. Thus, the plastic material consists of a kind of molecules in which both properties are distributed. Elastomer alloys are poly blends, i. e. mixtures of completed polymers, thus the plastic material consists of several kinds of molecules. Specific materials can be obtained by different mixing ratios and additives.

During the production of a shoe upper it is desired to influence locally the material properties of the material of the shoe upper selectively. Here, it is a specific aim to influence the breathability of the material and to ensure at the same time that an economical process is possible.

Thus, it is the object of the invention to create a process of the kind mentioned above by which this aim can be reached. Accordingly, a simple and cost efficient production should be possible, wherein the local material properties of the shoe upper can be influenced selectively.

The solution of this object by the invention is characterized in that at least partitions of the surface of the nonwoven fabric are exposed to a welding beam in such a manner, that in those partitions at least a partial melting of the nonwoven fabric takes place, so that the density of the material is increased in the molten partitions.

By this process it is possible—what will be apparent in detail later on—to improve and to influence respectively different surface properties.

Specifically preferred the nonwoven fabric consists of thermoplastic elastomere on the basis of urethane (TPU).

The nonwoven fabric can be produced from a single material layer. In this case it can be produced by the meltblown process.

However, an alternative suggests that the nonwoven fabric is produced from more than one material layer. Preferably at least one material layer of the nonwoven fabric is thereby produced by the meltblown process and at least a further layer of the nonwoven fabric is produced by the spunbond process.

The nonwoven fabric can be bonded with at least one layer of a textile material. A layer of textile material can thereby be arranged between two layers of nonwoven fabric.

During exposition to the welding beam on the exposed partitions of the nonwoven fabric a further material layer which is laid on the nonwoven fabric can be bonded with the nonwoven fabric. Alternatively, it can be also arranged with benefit that after the exposition to the welding beam on the exposed partitions of the nonwoven fabric a further material layer is applied on the cured nonwoven fabric.

The welding beam is preferably generated by a high frequency welding device, by an ultrasonic welding device or by a laser welding device.

Specifically, the welding beam is guided in such a manner that defined areas with increased density are produced. Those areas can have a lamellar shape or a ridge shape; the lamellar shaped or ridge shaped areas can thereby have a curvilinear form. Furthermore, the defined areas can have a circular shape or can have a closed ring structure.

With the proposed method it becomes possible to produce a shoe upper, i. e. a bootleg of a shoe, from a breathable material, wherein its constitution and properties are influenced selectively by a welding process. This possibility can be used particularly for the production of sports shoes for specific sports.

Furthermore, it can be achieved by the proposed process that no seam holes are generated during the connection process, i. e. the shoe which is produced by the proposed method has an increased watertightness.

No adhesion takes place between the shaft layers what ensures the maintenance of the breathability of the areas which are not welded.

Preformed shaft parts can be utilised, wherein especially deep-drawn formed parts made from the mentioned material are intended. This improves the correct fit of the shoe.

Furthermore, the shoe produced by the method has no annoying inseams.

The production can be arranged more economical by the process compared with conventional methods.

In the drawing an embodiment of the invention is depicted.

Figure 5:
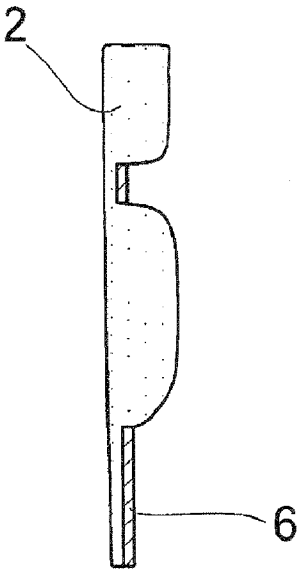
Figure 4:
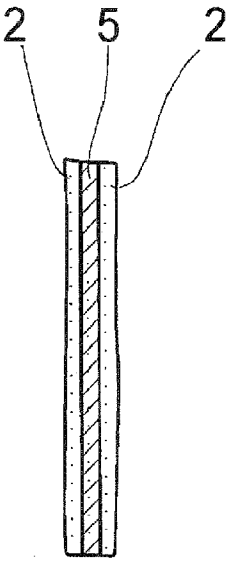
Figure 3:
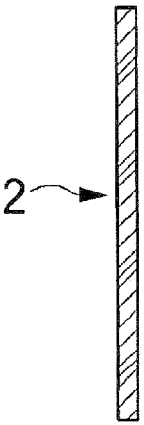
Figure 2:
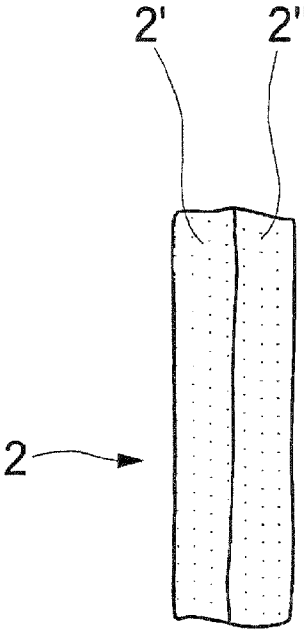
Figure 6:
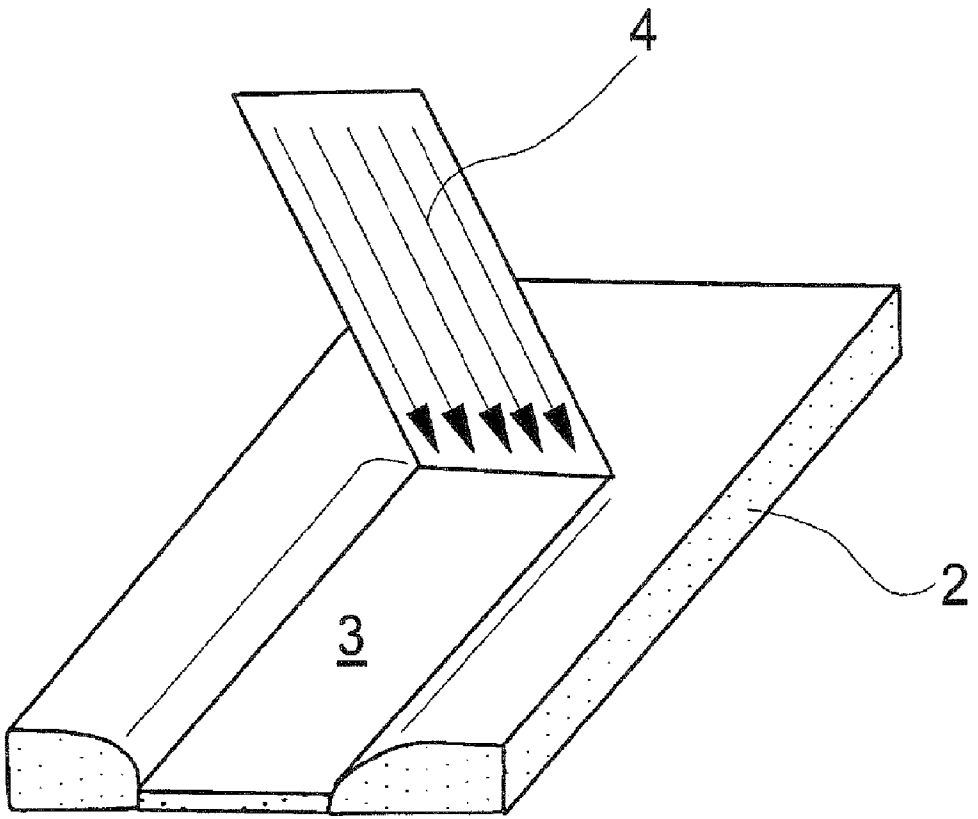

FIG. 1 shows a pre-cut part for a shoe upper of a sports shoe,

FIG. 2 shows the cross section A-A according to FIG. 1 through the shoe upper, FIG. 3 shows the cross section B-B according to FIG. 1 through the shoe upper, FIG. 4 shows the cross section C-C according to FIG. 1 through the shoe upper, FIG. 5 shows the cross section D-D according to FIG. 1 through the shoe upper and FIG. 6 shows a perspective view of the influence of a welding beam on the nonwoven fabric consisting of TPE.

In FIG. 1 a pre-cut part for a shoe upper of a sports shoe is shown. A layer 1 of a shoe upper can be seen which is not necessarily the only layer of the shoe upper. Below the depicted layer 1 further layers can be employed.

The layer 1 consists of a nonwoven fabric 2 which is produced from thermoplastic elastomer (TPE). In the present case thermoplastic elastomer on the basis of urethane (TPU) is specifically used.

Nonwoven fabrics are different from textiles which are characterized by the laying of the single fibres or filament according to the production method. In contrast, nonwoven fabrics consist of filaments which have a statistical alignment of the position, i.e. the filaments are arranged woozily to another in the nonwoven fabric. The typical English indication "nonwoven" distinguished them from the textiles. Nonwoven fabrics are differentiated inter alia by the polymer, the bonding process, the kind of fibre (pile or endless fibres), the fineness of the fibres and the orientation of the fibres. Thereby, the fibres can be laid selected in a preferred direction or totally stochastically as in the case of woozily layer nonwoven fabric. In the case of the isotropic nonwoven fabric the fibres have no preferred direction, if the fibres are arranged more frequently in one direction as in another direction anisotropy is given.

As the spinning method for the nonwoven fabric the known solidification method (bonding) on a thermal basis is used in the embodiment which is known under the designation SMS (spun—melt—spun). Here, for the production of the fibres a polymer is heated in an extruder and is put under high pressure. The polymer is pressed through a die (spinning nozzle) by means of spinning pumps exactly charged. The polymer leaves the nozzle plate as a fine fibre (filament) in still molten form. It is cooled by an air flow and is stretched out from the melt. The air flow transports the filaments to a conveyor belt which is designed as a sieve. The fibres are fixed by an aspiration under the sieve belt. This fibre arrangement is a woozily layer nonwoven fabric which must be solidified. The solidification can be carried out by two heated rolls (calendar) or by a flow of steam. The filaments fuse at the contact points and thus the nonwoven fabric is formed. Lighter nonwoven fabrics can be produced exclusively by this process (thermo bonding), heavier nonwoven fabrics are produced with a second introduced low-melting polymer, wherein the hot-melt adhesive is fused by a passage through a fixing furnace and the matrix filaments are agglutinated mostly at the cross-points, so that the desired solidity of the fleece is ensured.

As can be seen in FIG. 1 the surface structure of the layer 1 is not homogeneous but different zones are formed which are different with respect to the surface properties.

The nonwoven fabric 2 in the heel region should be characterized by softness and a sufficient breathability. Accordingly, here it is arranged—see the cross section A-A according FIG. 2—that two material layers 2' and 2" of the nonwoven fabric 2 are located on top of each other and form the shoe upper.

A bit further toward the toe-cap a partition 3 is desired as depicted in cross section B-B according to FIG. 3 in more detail. Here, a firm and thin section is desired which moreover should be transparent. This section if produced by means of a welding beam 4 as schematically depicted in FIG. 6.

The welding beam 4 (especially produced by an ultrasonic welding device, by a high frequency welding device or by a laser welding device) is directed onto the nonwoven fabric 2 as shown in FIG. 2. The welding beam 4 fuses the thermoplastic elastomere on the basis of urethane so that the relative fluffily structure with a respective low density of the material according FIG. 2 is changed. In fact, the plastic material is converted into a compact structure which has not only a significant higher density but the plastic material also becomes transparent. This can be used in a beneficial manner to create desired optical appearances of the shoe upper.

For the firm anchoring of loops 7 for threading laces in an area being located further in the front of the shoe upper partitions 3 are arranged which become apparent by the cross section C-C according to FIG. 4. Here, a layer made from textile material 5 (connected to the loops 7) is arranged between two layers of nonwoven fabric 2. The two layers of nonwoven fabric 2 are—as can he seen by comparison with FIG. 2 and in synopsis with FIG. 6—again compressed by means of the welding beam 4, i. e. they have been fused, but not necessarily to the level of density of the layer according to the cross section according to FIG. 3.

Finally, in the front region of the shoe once more different material properties are desired. Namely, on the one hand the shoe should have partially a high breathability, on the other hand also a very high arbrasion resistance should be given. This is achieved by the fact, that—see the cross section D-D according to FIG. 5—partitions 3 of the nonwoven fabric 2 are fused by means of the welding beam 4, wherein those partitions however are supplied with a further material layer 6. This layer can be applied during the welding process or it can be applied also later on onto the partitions 3, e. g. by glueing.

The untreated regions of the nonwoven fabric 2 which are not covered by the material layer 6 are highly breathable, while the regions covered with the layer 6 have a very high abrasion resistance.

Thus, the invention employs a TPE (TPU) nonwoven fabric which is preferably produced by the meltblown process; in the same manner a combination with material can be used which was obtained by the spunbond process, i. e. a SMS nonwoven fabric. By the meltblown process an elastic, abrasion resistant and also breathable nonwoven fabric is obtained which however has no specific good further rupture resistance. Due to the weight the material must be kept relatively thin (preferred thickness between 0.6 and 1.2 mm) Hence, it does not yet have sufficient elastic and damping properties, which are required e. g. for a soccer shoe in the shot area or for the shoe tongue as well as in the heel region as cushioning. To reach this the meltblown basic material is preferably "coated" with a spunbond fleece (see above comments concerning the SMS process). The spunbond can consist of the same but also of another basic material (especially from PP instead from TPU). The spunbond nonwoven fabric is basically quite similar to the meltblown nonwoven fabric, but it can differentiate significantly by the stiffness (fibres, which are up to the factor 10 thicker) and by the density.

The proposed welding creates the desired material properties. Also, the welding allows in a beneficial way the bonding of the shoe upper with adjacent parts of the shoe.

According to the intensity and duration of the welding process different properties of the basic material can be obtained:

By a very intensive and long welding the nonwoven fabric fuses and becomes compact and—depending on the specific basic material—transparent. By this a significant raise of the abrasion values and generally of the stiffness can be obtained.

By also intensive welding of areas or of lamellar-like or ridge-like structures the further rupture resistance can be increased. The nonwoven fabric fuses also in this case and becomes more compact (transparent) or less compact (half compact—translucent).

If the welding as the case may be is used only for the bonding of the nonwoven fabric with adjacent parts of the shoe, the breathability of the nonwoven fabric is kept completely.

Also, the welding can be selectively used for the creation of certain functionalities of the shoe upper. For example by welding loop reinforcements (as a substitute for lacing parts or rivets) or longitudinal or transversal reinforcements (as a substitute for bands) can be realized.

As explained above, the mechanical properties of the shoe upper material can also be improved when additional textile layers are welded in. This can occur directly on the front or rear side of the nonwoven fabric or as a sandwich structure between two layers of nonwoven fabric.

By the concept according to the invention a raise of the density of the material is obtained due to the welding, which is exposed to the welding beam. Here, the thickness of the material is preferably reduced to at the most 60% of the original thickness, specifically preferred to at the most 50% of the original thickness (measured at any one time in a compression free state). Accordingly, the density is increased at least by the factor 1.67, specifically preferred at least by the factor 2.

Reference Numerals

1 Layer of a shoe upper
2 Nonwoven fabric
2' Material layer
2" Material layer
3 Partition
4 Welding beam
5 Textile material
6 Further material layer
7 Loop

The invention claimed is:

1. A method for the production of at least one layer of a shoe upper or of a part of the shoe upper, comprising:

providing a first nonwoven fabric made of thermoplastic elastomer to be used as a basic material for at least a section of the layer or the part of the shoe upper, exposing at least portions of the surface of the first nonwoven fabric to a welding beam in such a manner that in those portions at least a partial melting of the first nonwoven fabric takes place, so that the density of the material is increased in the molten portions, providing a second nonwoven fabric, bonding the first and second nonwoven fabrics with at least one layer of a textile material, wherein the layer of textile material is arranged between the first and second nonwoven fabrics.

2. The method of claim 1, wherein the first nonwoven fabric consists of thermoplastic elastomer on the basis of urethane.

3. The method of claim 1, wherein the first nonwoven fabric is produced from a single material layer.

4. The method of claim 3, wherein the first nonwoven fabric is produced by the meltblown process.

5. The method of claim 1, wherein the first nonwoven fabric is produced from more than one material layer.

6. The method of claim 5, wherein at least one material layer of the first nonwoven fabric is produced by the meltblown process and at least a further layer of the first nonwoven fabric is produced by the spunbond process.

7. The method of claim 1, wherein during exposition to the welding beam on the exposed portions of the first nonwoven fabric a further material layer is laid on the first nonwoven fabric and is bonded with the first nonwoven fabric.

8. The method of claim 1, wherein after the exposition to the welding beam on the exposed portions of the first nonwoven fabric a further material layer is applied on the first nonwoven fabric.

9. The method of claim 1, where the welding beam is generated by a high frequency welding device.

10. The method of claim 1, where the welding beam is generated by an ultrasonic welding device.

11. The method of claim 1, where the welding beam is generated by a laser welding device.

12. The method of claim 1, where the welding beam is guided in such a manner that defined areas with increased density are produced.

13. The method of claim 12, where the defined areas have a lamellar shape or ridge shape.

14. The method of claim 13, where the lamellar shaped or ridge shaped areas have a curvilinear form.

15. The method of claim 12, where the defined areas have a circular shape or have a closed ring structure.

* * * * *